US009097053B2

(12) United States Patent
Drifka

(10) Patent No.: US 9,097,053 B2
(45) Date of Patent: Aug. 4, 2015

(54) HIGH-SPEED DOOR ASSEMBLY

(71) Applicant: Rytec Corporation, Jackson, WI (US)

(72) Inventor: Brian Norbert Drifka, Richfield, WI (US)

(73) Assignee: RYTEC CORPORATION, Jackson, WI (US)

( * ) Notice: Subject to any disclaimer, the term of this patent is extended or adjusted under 35 U.S.C. 154(b) by 0 days.

(21) Appl. No.: 13/751,257

(22) Filed: Jan. 28, 2013

(65) Prior Publication Data

US 2013/0133263 A1 May 30, 2013

Related U.S. Application Data

(63) Continuation of application No. 12/519,665, filed as application No. PCT/US2007/026429 on Dec. 27, 2007, now Pat. No. 8,360,132.

(60) Provisional application No. 60/877,475, filed on Dec. 27, 2006.

(51) Int. Cl.

| | |
|---|---|
| ***E06B 9/17*** | (2006.01) |
| ***E05F 15/20*** | (2006.01) |
| ***E06B 9/13*** | (2006.01) |
| ***E06B 9/58*** | (2006.01) |
| ***E05D 13/00*** | (2006.01) |

(Continued)

(52) U.S. Cl.

CPC ..... *E05F 15/20* (2013.01); *E05D 13/00* (2013.01); *E05D 15/165* (2013.01); *E05F 15/70* (2015.01); *E06B 9/13* (2013.01); *E06B 9/581* (2013.01); *E06B 2009/585* (2013.01)

(58) Field of Classification Search

CPC ..... E06B 9/582; E06B 9/42

USPC ..... 160/194, 195, 271, 41, 42, 272, 179, 160/242, 23.1

See application file for complete search history.

(56) References Cited

U.S. PATENT DOCUMENTS

| | | | | |
|---|---|---|---|---|
| 4,016,920 | A * | 4/1977 | Shepard | 160/133 |
| 4,887,660 | A | 12/1989 | Kraus | |
| 5,139,074 | A | 8/1992 | Warner | |

(Continued)

FOREIGN PATENT DOCUMENTS

| | | |
|---|---|---|
| GB | 2090895 | 7/1982 |

OTHER PUBLICATIONS

International Search Report for PCT application PCT/US2007/026429, 9 pages.

*Primary Examiner* — Blair M Johnson

(74) *Attorney, Agent, or Firm* — Factor Intellectual Property Law Group, Ltd.

(57) ABSTRACT

A high-speed door assembly for selectively permitting and prohibiting access through an opening in a wall, or other blocking structure, the door assembly having a shaft or drum located proximate the wall or other blocking structure and outside of the opening, and the shaft or drum having a longitudinal axis, and, a flexible door panel attached to the shaft or drum so as to be capable of being wound and unwound about the drum for selectively permitting and prohibiting access through the opening, the door panel being wound on the shaft or drum in an orientation such that the door panel defines at least one vertical plane when unwound from the shaft or drum, the vertical plane being spaced farther from the wall than the longitudinal axis of the shaft or drum is spaced from the wall or other blocking structure.

37 Claims, 8 Drawing Sheets

(51) Int. Cl.
*E05D 15/16* (2006.01)
*E05F 15/70* (2015.01)

(56) References Cited

U.S. PATENT DOCUMENTS

| | | | | |
|---|---|---|---|---|
| 5,141,043 | A | 8/1992 | Kraeutler | |
| 5,222,541 | A | 6/1993 | Hornberger | |
| 5,307,857 | A | 5/1994 | Kraeutler | |
| 5,307,859 | A | 5/1994 | Kraeutler | |
| 5,379,823 | A | 1/1995 | Kraeutler | |
| 5,450,890 | A | 9/1995 | Pinkalla et al. | |
| 5,655,591 | A | 8/1997 | Knutson | |
| 5,878,803 | A | 3/1999 | Kraeutler | |
| 5,964,271 | A | 10/1999 | Lapointe | |
| 6,089,305 | A | 7/2000 | Gruben et al. | |
| 6,357,507 | B1 * | 3/2002 | Stoebich et al. | 160/41 |
| 6,394,172 | B1 | 5/2002 | Kessous | |
| 6,574,832 | B1 | 6/2003 | Boerger et al. | |
| 8,316,915 | B2 | 11/2012 | Drifka et al. | |
| 8,360,132 | B2 | 1/2013 | Drifka | |
| 2002/0139491 | A1 | 10/2002 | Langenbach | |
| 2005/0211391 | A1 | 9/2005 | Varley et al. | |
| 2006/0144530 | A1 * | 7/2006 | Nagare et al. | 160/271 |
| 2010/0032105 | A1 | 2/2010 | Drifka | |
| 2011/0005138 | A1 | 1/2011 | Drifka et al. | |

* cited by examiner

HIGH-SPEED DOOR ASSEMBLY

REFERENCE TO RELATED APPLICATIONS

This application is a continuation of U.S. patent application Ser. No. 12/519,665 filed Jun. 26, 2009 which is a National Phase Application of PCT Patent Application No. PCT/US2007/026429 filed Dec. 27, 2007 which relies on the priority of U.S. Provisional Application No. 60/877,475 filed Dec. 27, 2006. The contents of each of these applications are incorporated herein by reference.

TECHNICAL FIELD

The present invention relates to an industrial high-speed door assembly, and more specifically, to facilitating the sealing and realignment of a flexible door panel that is opened and closed to permit access and block access to an opening in a wall when it is displaced by an atypical force dislodging the door panel from its guides.

BACKGROUND OF THE INVENTION

High-speed industrial doors, which are capable of being rolled up on a shaft or drum to open, have long been used in the storing and staging areas of commercial buildings such as factories and warehouses. Materials handling machinery, such as conveyors and lift trucks are commonly used to transport items to, from, and between storage areas and staging areas such as loading docks. In such applications, as well as others known in the art, the industrial doors are often required to open quickly, such as opening at a rate of approximately 48 inches per second up to 100 inches per second or greater. This speed enhances productivity, cost savings, and safety, especially where cold storage and distribution is involved. Additionally, specific environmental or security requirements may need door speed and sealing integrity to be maintained in either the storing or staging area or both, e.g., temperature, cleanliness, etc.

Today's high-speed industrial door assemblies include a pair of vertically oriented assemblies installed proximate the vertical sides of an opening of the passage and are sometimes called "side columns." The side columns have structures which guide the flexible door panel during opening and closing. These "guides" provide surfaces which engage a vertical marginal edge portion of the moving door panel therein. The guides are located proximate the vertical sides of the passageway that includes an opening having a width. The guides do not extend into the width of the opening so as to maximize the clear path of travel for personnel and vehicles in the traverse of commercial traffic through the passage. The door panel, often including its accompanying parts, e.g., a relatively rigid bottom bar, guide retention means such as rollers, knobs, etc., is made wider than the width of the opening such that a marginal portion of the door panel on each side of the opening near the vertical side edges thereof, extends into and is thus guided or retained within the guides.

Even though the door panel is moved vertically at a relatively fast rate, there are times when the door panel—or a portion of the door assembly itself—is impacted by a vehicle and dislodged from at least one of the guides. The door assembly cannot operate properly until the displaced door panel is reconfigured to be within the door assembly's guides so as to be in its normal operating configuration.

Reconfiguring or "repairing" the door's guiding function after an impact has been the subject of the design of others including the applicants of this application. However, the prior art has only limited or no solutions for restoring or "repairing" of an automatic high speed roll up door when it is dislodged in a direction which places the panel inside of, or through, the opening of the passage. In this case, with a conventional roll-up door, the wider door panel will be pushed through the narrower opening distorting its normal shape so as to comply with the width of the opening of the passage. As a result, the door panel and its associated structures as well as the side columns and the wall portions constituting the opening, are more susceptible to damage both because of the dislodging and the gesticulations required to repair the door to its operational state. In addition, there are commercial losses due to time and productivity lost while the door is in disrepair. The repair from such a dislodgement is routinely accomplished through human operator effort, and is not automated. The door panel must be moved back to the other side of the opening before being realigned and reinserted within the guides. Returning the door panel to the door-assembly side of the opening can be difficult—perhaps even requiring disassembly of portions of the door assembly—and may incur additional time, and further expose the door panel to more damage.

It is known in U.S. Pat. Nos. 5,141,043 and 5,319,015 to provide a "self-repairable" industrial door assembly having side uprights each including a slideway having a guide wall on either side of the plane of a door panel or curtain. Lateral portions of the curtain slide within the slideways and are adapted to escape from the slideways in the event of an abnormal or atypical transverse force. At least one of the slideways includes a movable wall element capable of temporarily deforming so as to form a path enabling the lateral portion of the curtain to pass from the outside to the inside of the slideway. Unfortunately, the operative reconfiguration of a displaced curtain from a high speed automatic roll up door that has been pushed through the opening remains unaddressed.

The present invention is provided to address these and other considerations.

SUMMARY OF THE INVENTION

According to an embodiment of the invention a high-speed door assembly comprises a shaft or drum having a longitudinal axis which is configured so that the longitudinal axis is parallel with a wall to which the door assembly is mounted. A flexible door panel is attached to the shaft or drum so as to be capable of being wound and unwound about the drum for selectively permitting and prohibiting access through an opening in the wall to which the door assembly is mounted. The door panel is wound on the shaft or drum in an orientation such that the door panel defines at least one vertical plane when unwound from the shaft or drum, the vertical plane being spaced further from the wall to which the door assembly is mounted than the longitudinal axis of the shaft or drum.

According to an embodiment of the invention, the door panel having at least a lower portion of which is substantially equal to, or less than, the width of the opening.

According to an embodiment of the invention, first and second guides are operatively mounted proximate the opening and having a portion thereof with opposed guide surfaces extending into a width of the opening, the at least a portion thereof being adapted to move in a direction to reduce their extension into the opening width upon impact of the door by an atypical force, According to an embodiment of the invention, the collapsible first and second guides are respectively mounted to the opposed sides within the opening.

According to an embodiment of the invention, the door includes a controller which is operatively connected to an electric motor having a plurality of operating modes, one of which is capable of moving the door panel at a rate of speed of at least 48 inches/second but optimally 80 to 100 inches per second.

According to an embodiment of the invention, the door including a portion of either the first or second guide being flexible so as to retreat at least partially from protrusion into the opening width upon impact thereto and being capable of substantially returning to an operative configuration.

According to an embodiment of the invention, the high-speed door assembly includes that each guide includes realignment surfaces angled to facilitate automated return of the door panel into their respective guides whether or not the dislodgement moved the door panel away from the opening or into the width of the opening.

According to an embodiment of the invention, the high-speed door assembly provides that the realignment surfaces comprise a compound angle.

According to an embodiment of the invention, the high-speed door assembly provides that the guides are formed by two opposing vertical elements presenting at least one vertical surface which is disposed at and angle to the vertical plane of the door panel.

According to an embodiment of the invention, the high-speed door assembly provides that the sensor is configured to detect displacement of the door panel from its typical operative path of travel and to transmit a signal to the electric motor indicating displacement of the flexible door panel from its typical operative path of travel; and, a controller and motor are configured to reduce the speed of travel of the flexible door panel in response to the detection of the displacement of the flexible door panel from its typical operative path of travel.

According to an embodiment of the invention, the high-speed door assembly comprises a first guide operatively mounted proximate the opening and having opposed surfaces between which a portion of the door panel is guided during opening and closing and wherein at least a portion of the opposed surfaces extends into the opening and a second guide operatively mounted proximate the opening and having opposed surfaces between which a portion of the door panel is guided during opening and closing and wherein at least a portion of the opposed surfaces extends into the opening. A guide moving assembly being operatively connected to at least one of the first or second guides, where, in conjunction with opening and closing of the door panel, at least a portion of the at least first or second guides is movable between a first position and a second position.

According to an embodiment of the invention, a high-speed door assembly provides that the at least first or second guides extends operatively into the opening in the first position to guide the door panel, and a portion of the at least first or second guide does not significantly extend into the opening in the second position.

According to an embodiment of the invention, a high-speed roll door assembly comprises a flexible door panel wound and unwound on a drum for providing or denying access through an opening, the door panel generally defining a plane and being guided by at least a portion of its vertical margins by vertically oriented guides positioned proximate opposed vertical sides of the opening. The guides each having an outer surface directly exposed to vehicle traffic in a first direction through the opening and in an opposite direction through the opening, said outer surfaces being disposed at an angle to the plane of the door panel. According to an embodiment of the invention, the angle of the vertical outer surfaces dissect the plane of the door panel and each other. According to an embodiment of the invention, the guides each have a funnel shape formed at upper ends thereof sized and shaped so as to permit the door panel to reenter the guide after being dislodged therefrom. According to an embodiment of the invention, the guides each have pairs of compound angles formed at the upper ends thereof where one set of angles forms a funnel shape between them with respect to a thickness of the door and wherein the other set of angles form a funnel relative to a width of the door panel. According to an embodiment of the invention, each guide having a vertical opening or guide slot formed by inner surfaces of the guides, and each vertical opening having a pair of canted vertical seals resiliently urged toward and into contact with the door panel when it is in the guide opening. According to an embodiment of the invention, the guides are comprised in significant part by hollow extrusions. According to an embodiment of the invention, the guides are comprised in significant part by fiberglass. According to an embodiment of the invention, the guides or guide bodies are comprised of a non-thermal conductor material including one or more of a polymeric resin, or a filled polymeric resin (e.g. glass-filled, carbon-filled, cellulouse-filled, etc.), or other material with relatively low thermal conductivity. According to an embodiment of the invention, the guides or guide bodies are comprised of a resilient material including one or more of a natural or synthetic polymer such as, Buna-n, Buna-S, or other tough materials which will resiliently return substantially to their former shape after at least one impact by a motorized vehicle. According to an embodiment of the invention the guide or guide body extrusions are hollow and are filled with a thermally insulating material such as a polymeric open or closed cell foam.

According to an embodiment of the invention, a high-speed roll door comprises a flexible door panel wound and unwound on a drum or the like to prevent and permit access to an opening in a wall. One or more seals making contact with the door panel when the panel is unwound, the seals assisting in sealing the opening. The door panel being oriented on the drum or the like in a way that contact between the seals and the door panel is lost as the panel is wound up and is gained nearer to the final unwound position which prevents access to he opening.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

In the drawings:

FIG, 1 is a front view of one embodiment of the present invention;

Figure 1:
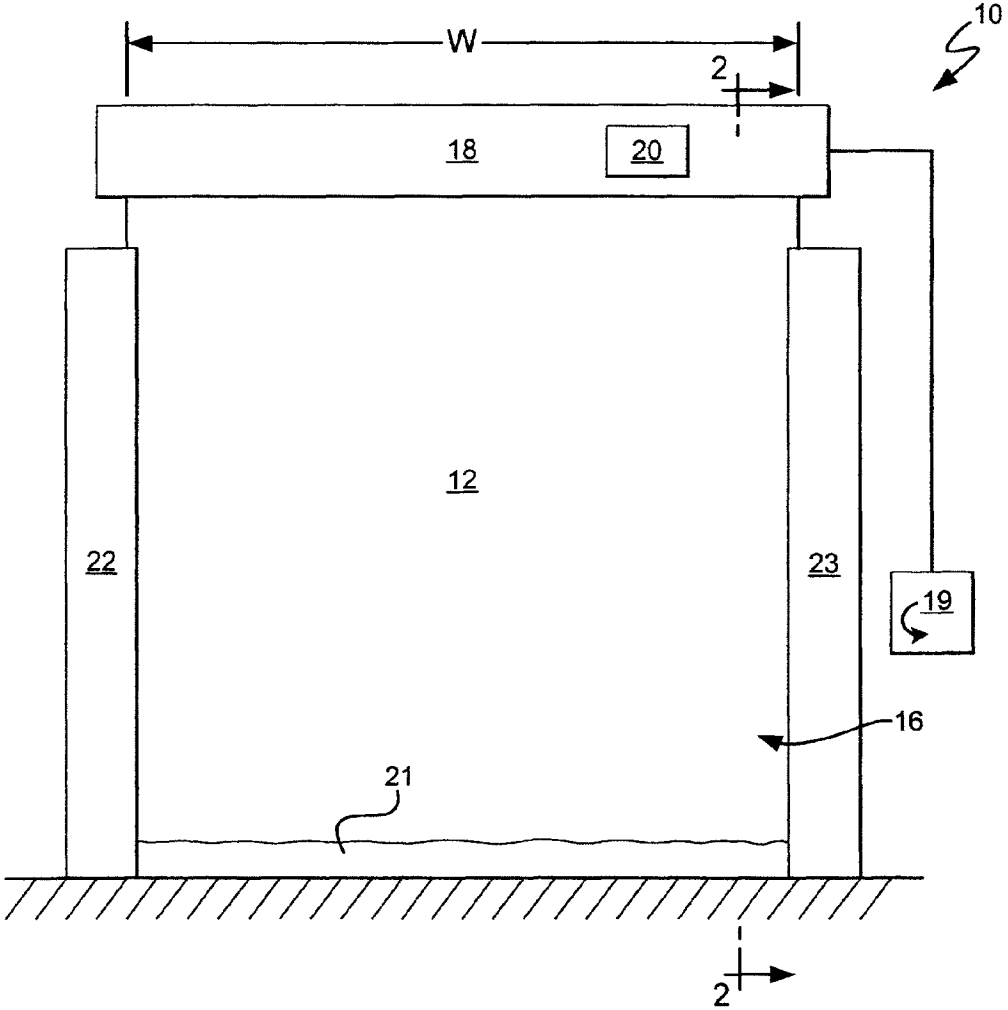
Figure 4:
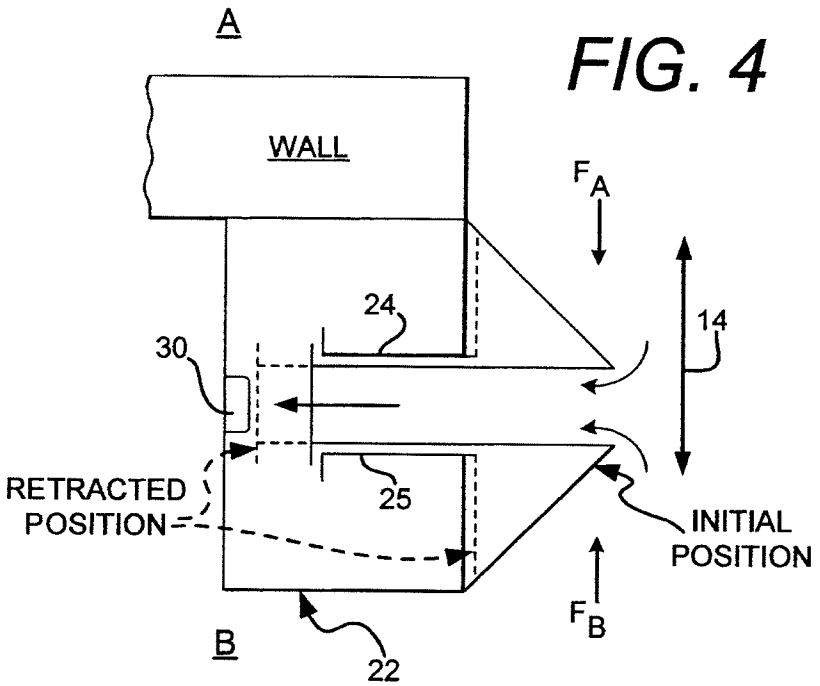
Figure 3:
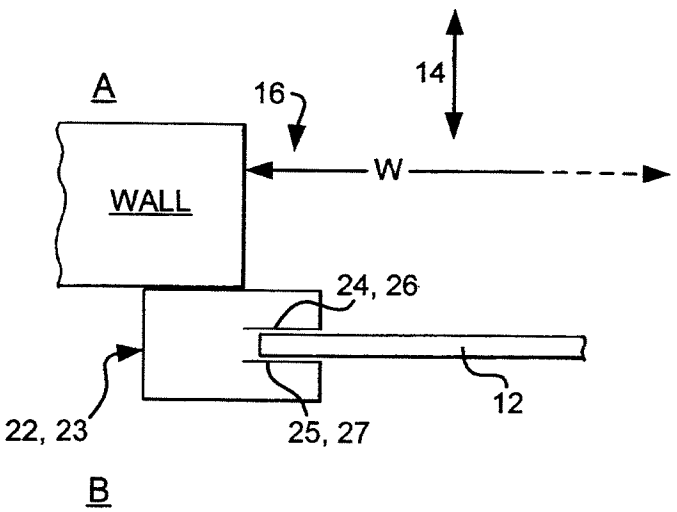
Figure 6A:
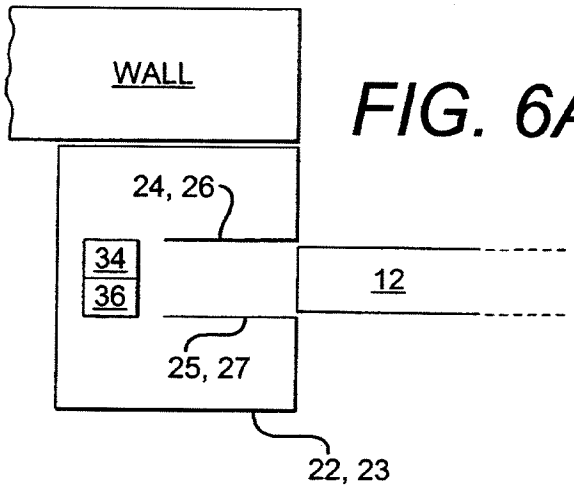
Figure 6B:
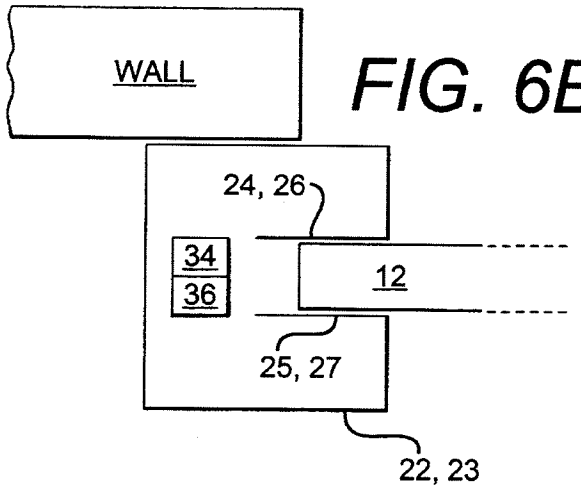
Figure 9:
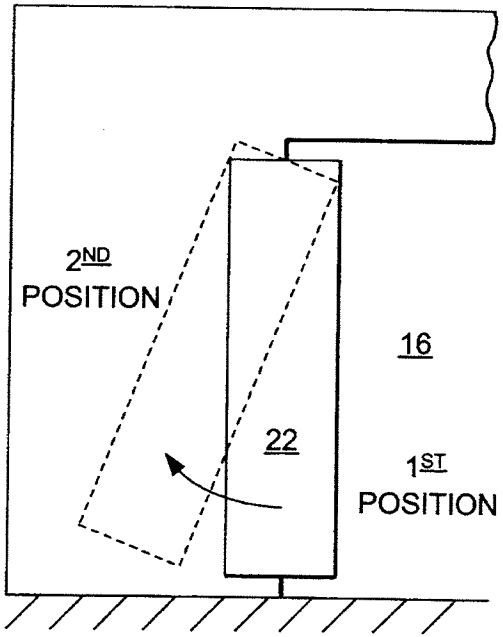
Figure 7A:
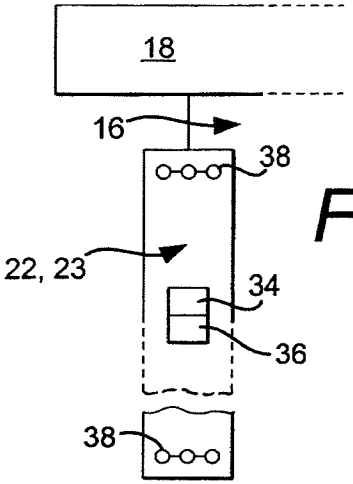
Figure 7B:
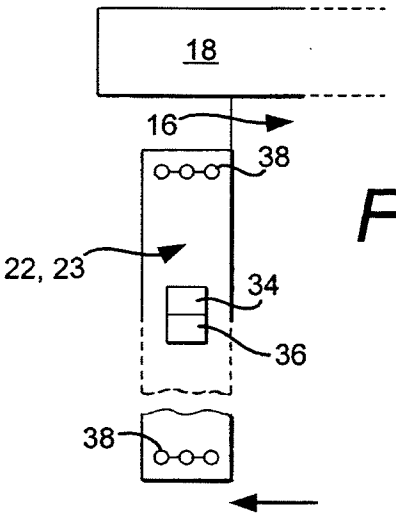
Figure 8A:
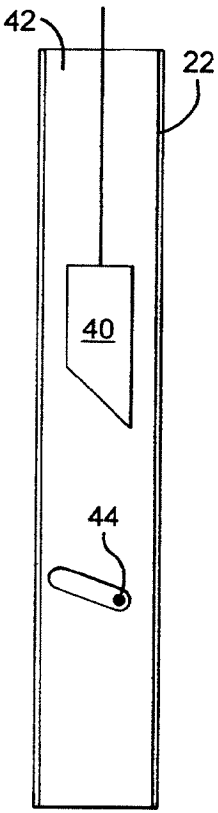
Figure 8B:
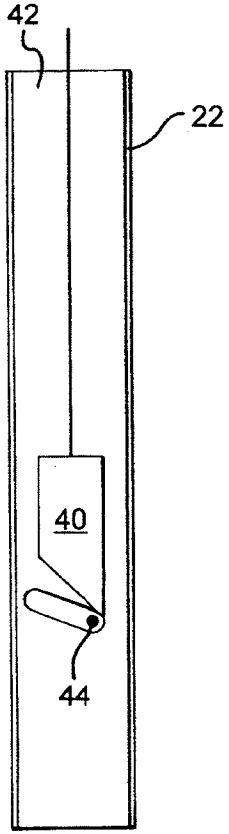
Figure 8C:
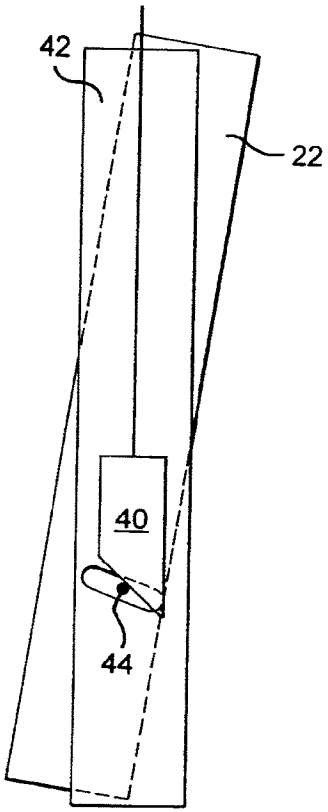
Figure 8D:
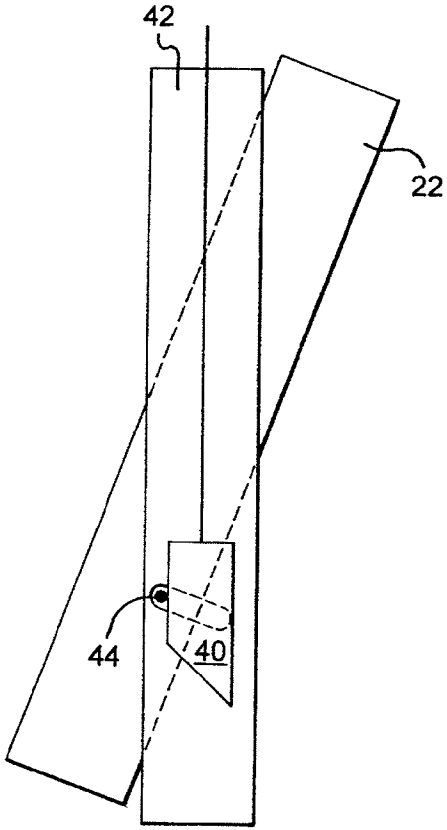
Figure 10C:
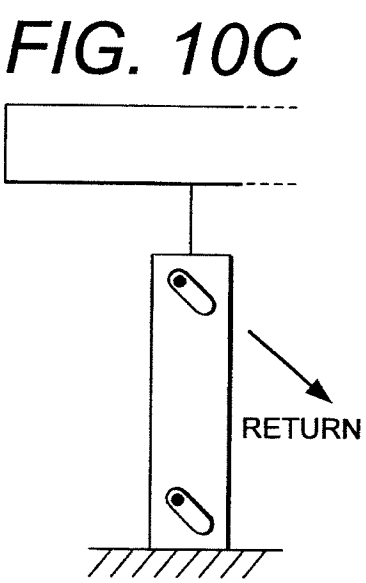
Figure 10B:
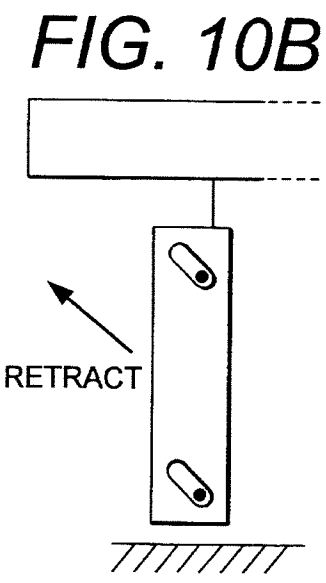
Figure 10A:
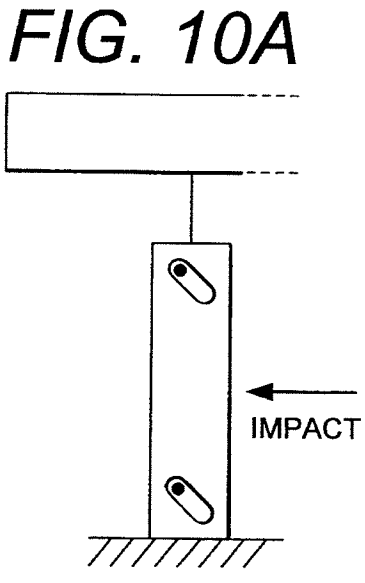
Figure 11:
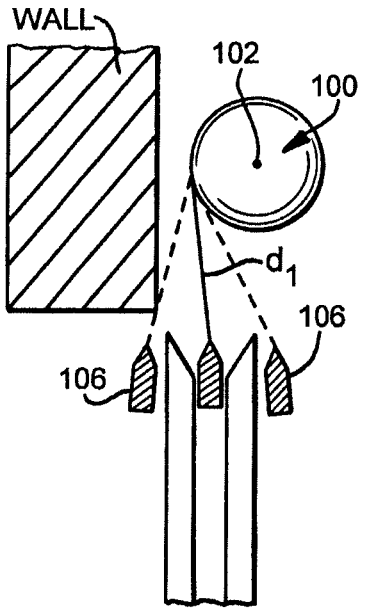
FIG. 11 PRIOR ART
Figure 12:
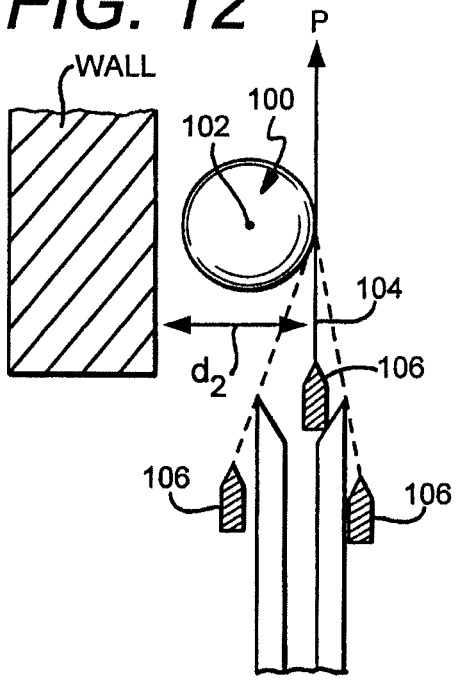
Figure 13:
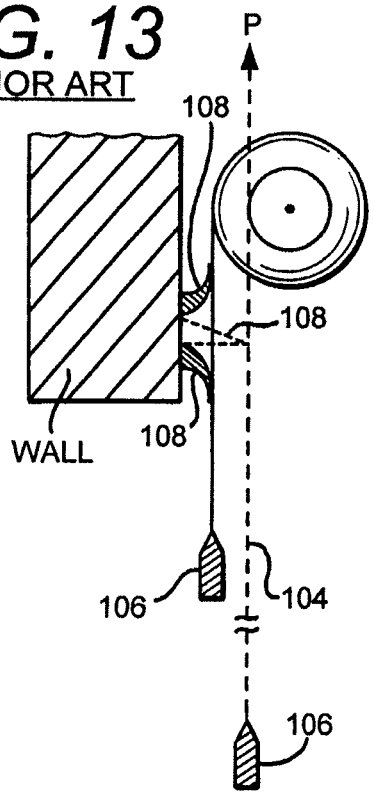
FIG. 13 PRIOR ART
Figure 14:
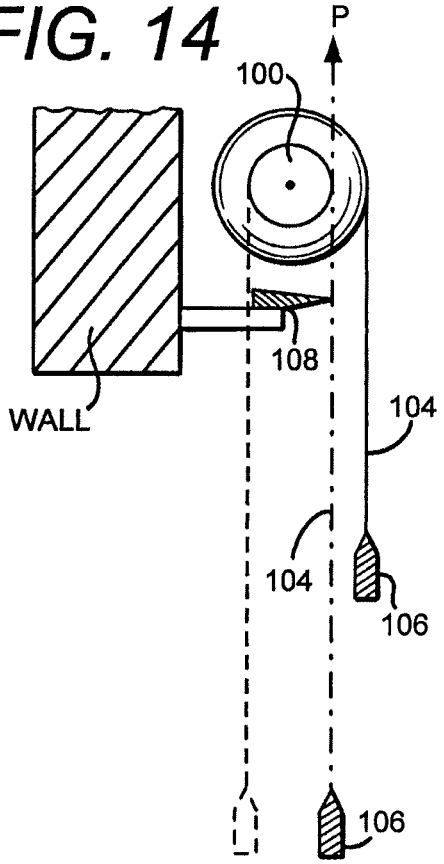
Figure 15:
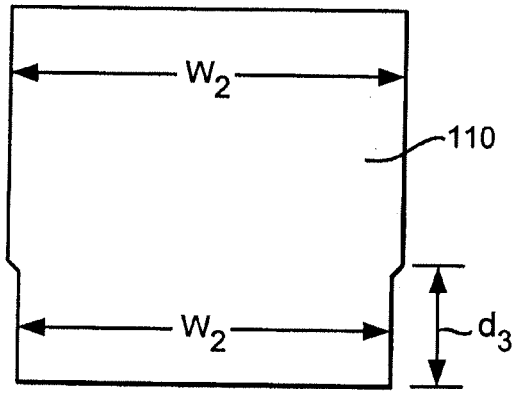
Figure 16:
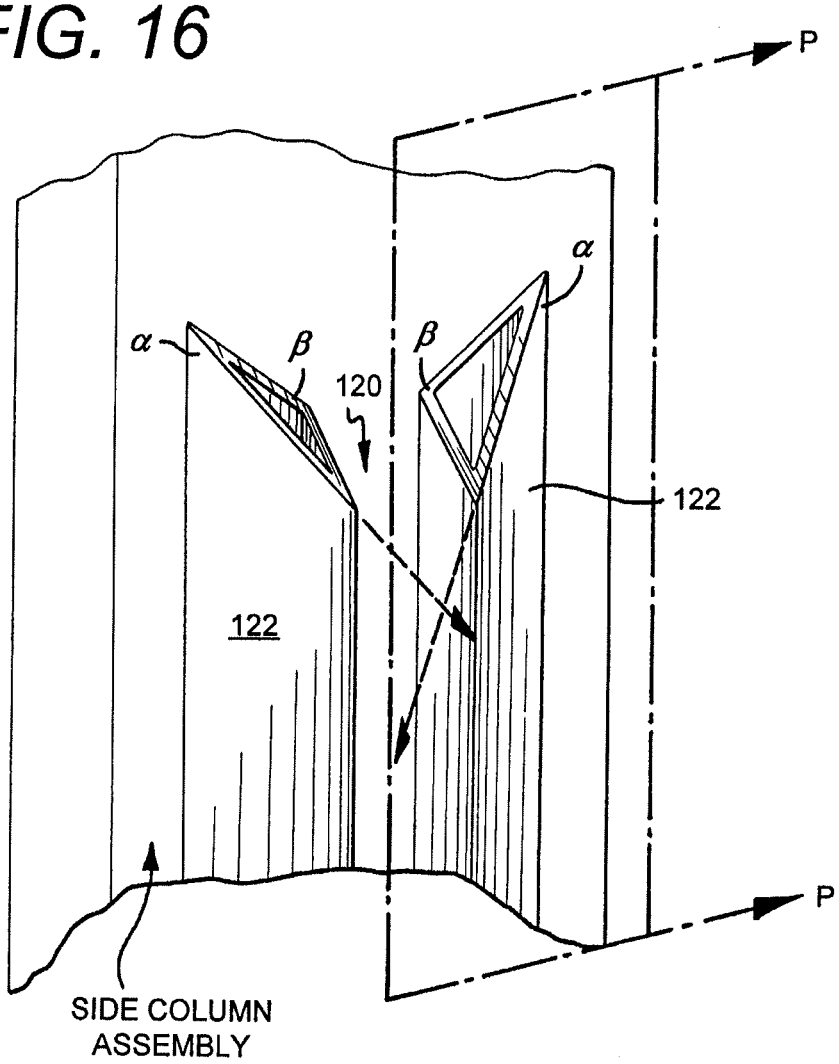

FIG, 2 is a partial cross-section view of the present invention shown in FIG. 1 and taken along line 2-2;

FIG. 3 is a partial top view of the present invention shown in FIG. 1;

FIG. 4 is a partial top view of another embodiment of the present invention;

FIG, 5 is a partial side view of another embodiment of the present invention;

FIGS. 6A and 6B are partial top views of another embodiment of the present invention depicting a movable guide;

FIGS, 7A and 7B are partial front views of the present invention shown in FIGS. 6A and 6B;

FIGS. 8A-8D are partial front views of another embodiment of the present invention depicting a movable guide;

FIG. 9 is a partial front view of the present invention shown in FIGS. 8A-8D;

FIGS. 10A-10C is a partial front view of another embodiment of the present invention depicting a movable guide utilizing a gravity or shape based bias mechanism;

FIGS. 11 and 13 are diagrammatic views of prior art drums for a roll door;

FIGS. 12 and 14 are schematic or diagrammatic views of a drum for rolling a flexible panel according to the invention;

FIG. 15 is a schematic view; and,

FIG. 16 is a front view of a guide according to the invention.

DETAILED DESCRIPTION

While the present invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a high-speed door assembly 10 that vertically moves a door panel 12 to permit and prohibit access through a passageway 14. The passageway 14 includes an opening 16 having a width W defined by opposed sides wherein the passageway extends parallel to and beyond the opening. To permit access through the passageway 14, the door panel 12 is rolled up over a drum, track, rail, and the like, and accumulated overhead. Preferably, the door panel 12 is a continuous piece of material, e.g., a flexible sheet or panel, and may also be a plurality of segmented sheets or panels.

A drive means 18, e.g., motor, is operatively connected to the door panel 12 and is mounted above the passageway 14 to move the door panel up and down. The drive means 18 may also include a controller 19 and a sensor 20. The controller 19 is responsive to the sensor 20 and has a plurality of operating modes in which to control the operation of the drive means 18 to move the door panel 12 at a speed of approximately 0-100 inches/second. The drive means 18 is responsive to the controller 19 and is preferably mounted to either side of the opening 16, but may also be mounted within the opening itself.

The high-speed door assembly 10 is adapted for displacement of its door panel 12 from its operative path of travel upon receiving an atypical dislodging force. Such dislodging forces may result from transverse contact by a lift truck. The sensor 20 is capable of detecting atypical alignment of the door panel 12 with its guide(s) 22, 23. Upon detection of a misaligned guide 22, 23 by the sensor 20, the controller 19 will be alerted and control the drive means 18, wherein the speed and/or travel direction of the door panel 12 can be changed.

Figure 2:
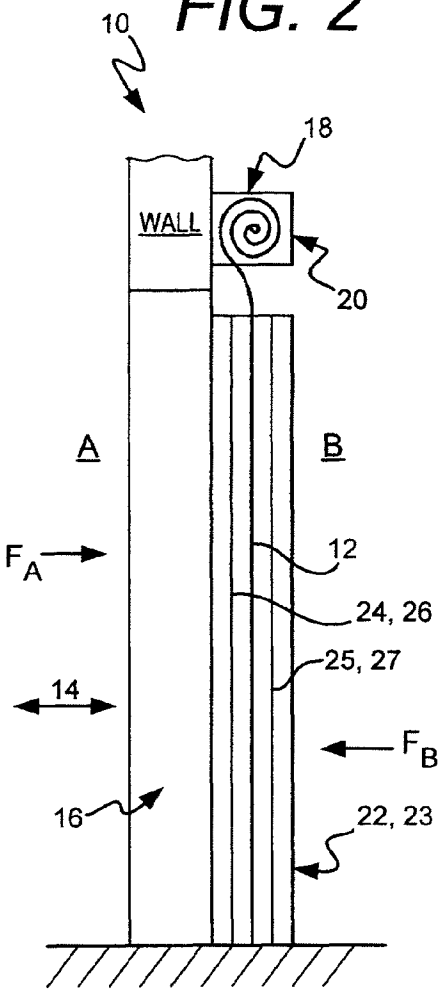

One embodiment of the present invention is shown in FIGS. 1-3 and includes a first guide 22 operatively mounted near the opening 16 and having opposed surfaces 24, 25 between which a portion of the door panel 12 is guided during opening and closing and wherein at least a portion of the opposed surfaces 24, 25 extends into the opening 16. A second guide 23 is operatively mounted near the opening 16 and includes opposed surfaces 26, 27 between which a portion of the door panel 12 is guided during opening and closing and wherein at least a portion of the opposed surfaces 26, 27 extends into the opening 16. The first guide 22 is spaced apart from and aligned with the second guide 23 to define a path of travel 28 for the door panel 12 such that a portion of the door panel—near the sides of the door panel—is guided within the first 22 and second 23 guides. To a large extent, the path of travel 28 is in a plane that is substantially parallel with the opening 16 and substantially perpendicular to the passageway 14.

Referring now to FIG. 4, another embodiment of the present invention includes a portion of at least one of the first 22 or second 23 guides being collapsible so as to initially retract from the opening 16 upon impact thereto and then rebound to substantially return to its initial operative configuration. The collapsible guide 22, 23 may include a flexible material, e.g., rubber, having an inherent resiliency due to its shape, composition, or a combination thereof. It is further contemplated that a bias means 30 can be utilized with the guide 22, 23 to achieve an amount of collapsibility to facilitate temporary flexing or retracting upon impact and then subsequent return to its substantially original configuration. Mechanical bias mechanisms, e.g., spring, coil—as well as gravity or shape based bias mechanisms—can be operatively connected to the guide. In FIG. 10A-10C, a gravity or shape based bias mechanism 31 is shown wherein the guide 22, 23 essentially suspends proximate the opening 16. The guide includes a slanted slot 33 wherein a pin 35 is located therein. Upon receiving an impact, the guide 22, 23 will retract from the impact. Due to the geometrical configuration of the gravity or shape based bias mechanism 31, the guide 22, 23 will slide slightly upward along the pin 35 and then eventually return to its original position.

Figure 5:
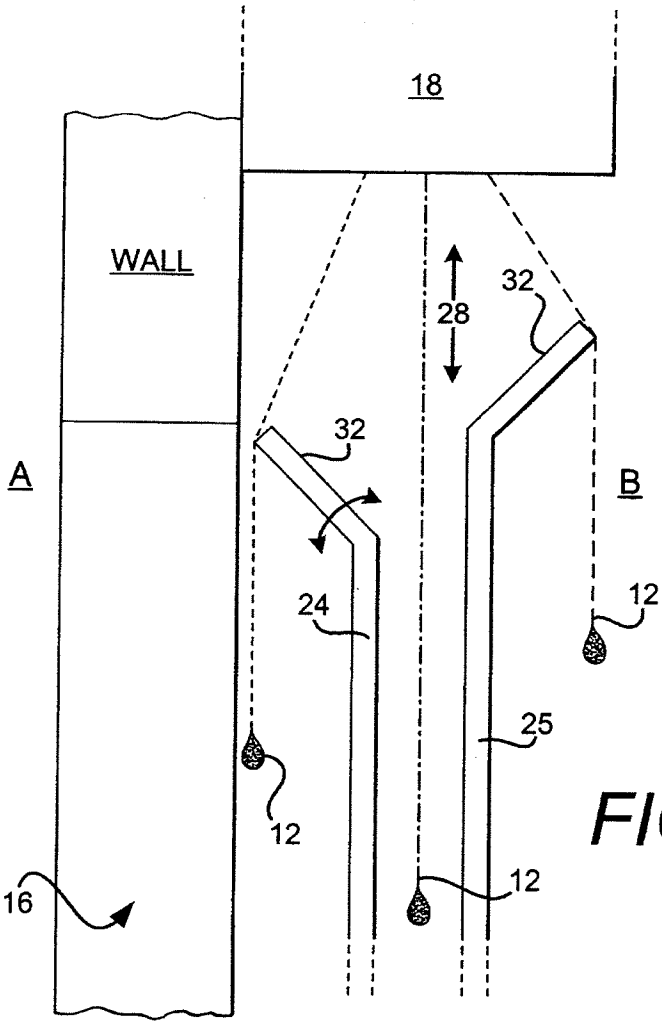

Another aspect of the present invention is shown in FIG. 5, wherein at least one—preferably both—of the guides 22, 23 of the high-speed door assembly 10 includes a realignment ramp 32 attached thereto and proximate the top of the opening 16. The realignment ramp 32 projects upward and at an angle away from the path of travel 28 so as to facilitate operative alignment of the door panel 12 within the path of travel subsequent to displacement of the door panel from the guides 22, 23.

Displacement of the door panel 12 can result from contact of a sufficient force $F_A$, $F_B$ upon the door panel to dislodge it from at least one of the guides 22, 23. The dislodging force can approach from either side A, B of the opening 16. Upon displacement of the door panel 12 from guide(s) 22, 23, the drive means 18 preferably halts movement of the door panel for a predetermined amount of time and then reinitiates movement of the door panel such that the dislodged door panel will eventually approach the top of the opening 16 wherein the bottom portion of the door panel will slip over and past the realignment ramp 32 and return within the guides 22, 23 for subsequent operation.

Upon receiving a sufficient force $F_B$ on the side B of the opening 16 where the high-speed door assembly 10 is mounted, the door panel 12 will dislodge from at least one of the guides 22, 23. Because the guides 22, 23 extend into the opening 16, the width of the door panel is less than or equal to the width W of the opening. As such, the door panel 12 is permitted to more freely move through the opening 16 and is primarily prevented from returning through the opening by the guides 22, 23 extending therein—as opposed to the structure, e.g., wall, defining the sides of the opening. Upon detection of the displaced door panel 12, the sensor 20 will send a signal to the controller 19. The controller 19 will change the operating mode of the drive means 18 and the door panel will eventually be moved up toward the top of the opening 16 and pass by the realignment ramp 32 to return within the guide and on plane within the path of travel 28.

The realignment ramp 32 is movable so that the entire door panel 12 will eventually be pulled past the movable realignment ramp and return between the guides 22, 23. Various embodiments of the movable realignment ramp 32 are envisioned by the present invention, including, and not limited to: being operatively attached to one of the surfaces 24, 25, 26, 27 of the guides 22, 23; being integral with one of the surfaces of the guides; and being biased—inherently via physical composition or shape, or mechanically, e.g., spring, coil, and the like.

In a preferred embodiment, each guide 22, 23 will include a pair the realignment ramps 32 to facilitate normal operative configuration of the door panel 12 independent of the side of the opening 16 on which the door panel is displaced.

As shown thus far, due primarily to the configuration of the guides 22, 23 extending within the opening 16, the "self-repairable" high-speed door assembly 10 of the present invention is capable of quick and easy reconfiguration regardless of the direction of the dislodging force. And although the extension of a portion of the guides 22, 23 appears to lessen the width W of the opening 16, the movable guide described herein is capable of collapsing and/or retracting and thus effectively providing a width substantially as wide as the opening.

Alternatively, another aspect of the present invention is shown in FIGS. 6A, 6B, 7A, and 7B and is directed to a guide moving assembly 34 that is operatively connected to at least one of the guides 22, 23. In conjunction with raising and lowering of the door panel 12, a portion of one of the guides is movable between a first position and a second position. In the first position, the guide(s) extends into the opening 16, (see FIGS. 6A and 7A) and in the second position, at least a portion of the guide(s) does not extend into the opening (see FIGS. 6B and 7B); and vice versa. The guide moving assembly 34 includes an actuator 36 operatively connected to the guide(s) 22, 23. Preferably, the actuator 36 cooperates with a track 38—single or multiple rail—upon which the guide 22, 23 is operatively connected. The actuator 36 cooperates with the track 38 to move the guide 22, 23 between the first and second positions. Upon detection of an approaching vehicle intending to travel through the opening 16, the actuator 36 will move at least a portion of the guide(s) 22, 23 from its initial position so as not to extend into the opening. Thus, as the door panel 12 is being moved upward to permit access through the opening 16, at least a portion of the guide(s) 22, 23 will be moved and retracted from substantially extending into the opening to expose its full width W for passage of the vehicle there through. Subsequent to the passage of the vehicle through the opening 16 and in conjunction with the downward movement of the door panel 12 to prohibit access through the opening, the actuator 36 will return the guide(s) 22, 23 to its initial position as the door panel 12 is lowered.

It is to be understood that various types of actuators known to one of ordinary skill in the art can be utilized with the present invention, including, and not limited to: a motor and cooperating cam, an air cylinder, and an electric solenoid.

Another embodiment of an alternate guide moving assembly is shown in FIGS. 8A through 8D, 9A, and 9B and includes a counter-weight 40 operatively attached to the door panel—preferably via the drive means 18. The counter-weight 40 is a source of potential energy utilized to facilitate the upward movement of the door panel 12 along its path of travel 28. The guide 22, 23 is preferably pivotably mounted near the opening 16 and operatively attached to a chute 42. Although the guide 22, 23 extends into the opening, the chute 42 does not. The chute 42 includes a path for the counter-weight 40 to travel. A deflection member 44 is attached to the guide 22, 23 and in line with the counter-weight's path within the chute 42. Upon opening the door panel 12, the counter-weight 40 will eventually contact the deflection member 44 wherein the guide 22, 23 will be subsequently moved from its first position. Upon closing of the door panel 12, cooperation of the counter-weight 40 with the deflection member 44 will eventually move the guide 22, 23 from its second—retracted—position and return it to its first position.

Due to the pivotable mounting of the guide 22, 23 near the opening 16, it is apparent that although a portion of the guide will be retracted to expose the full width W of the opening, a portion of the guide may remain or further extend into the opening. When permitting access through the opening 16, it is preferable to move the pivotable guide(s) 22, 23 such that the full width W of the opening 16 is exposed to a height of at least approximately 4 feet to accommodate unencumbered passage of transport vehicles through the opening. In consideration of the interrelated and/or cooperating components of the high-speed door assembly 10 of the present invention—e.g., height and width of opening 16 and door panel 12; degree of pivot for the guide 22, 23; shape or geometry of the counter-weight 40 and the cooperating deflection member 44—it is further apparent that without undue experimentation, the door assembly of the present invention can be configured by one of ordinary skill to attain the desired operating characteristics of the high-speed door assembly.

The movable characteristics of the guides 22, 23 described herein, whether the guide is collapsible, retractable, or pivotable, provide the high-speed door assembly 10 of the present invention with ability for adaptation as a separator between differing environments, e.g., cold/warm storage, humidity, clean rooms. It is contemplated by the present invention that the guides 22, 23 can be extruded of an engineered material, e.g., plastic, fiberglass, foam, and combinations thereof, that lend themselves to use in such environments, wherein lower costs due to repair or replacement will be achieved. For example, energy costs related to insufficient insulation or the prevention/reduction of accumulated frost on the guide 22, 23 can be reduced by the implementation of guides including specifically engineered material(s) suited for such purposes.

FIGS. 11 and 13 disclose a prior art arrangement of a drum for rolling up and down or winding and unwinding a flexible door panel to selectively block or permit access through an opening in a wall. FIGS. 12 and 14 disclose an embodiment of the invention which can be preferably used with any of the door assemblies disclosed herein. In sum, FIGS. 12 and 14 disclose a high-speed door assembly which comprises a shaft or drum 100 having a longitudinal axis 102 (shown as in and out of the page in FIG. 12) which is configured so that the longitudinal axis (identified by the dashed lines and letter "P") which is parallel with a wall (identified by the word "wall") to which the door assembly is mounted. A flexible door panel 104 is attached to the shaft or drum 100 so as to be capable of being wound and unwound about the drum 100 for selectively permitting and prohibiting access through an opening in the wall to which the door assembly is mounted. The door panel 104 is wound on the shaft or drum (in contrast to FIGS. 11 and 13) in an orientation such that the door panel defines at least one vertical plane (shown by arrow "P" in FIGS. 12 and 14) when unwound from the shaft or drum. As is shown in FIGS. 12 and 14, the vertical plane P is spaced further from the wall to which the door assembly is mounted than the longitudinal axis of the shaft or drum, As disclosed in FIGS. 12 and 14, and by comparison with the prior art disclosed in FIGS. 11 and 13, the orientation of this embodiment permits the guides for the panel 104 to be moved out from the wall which gives more space between the guides and the wall to allow a bottom bar 106 to fit between the wall and the guides to repair the door panel 104 if it becomes dislodged from the guides. This arrangement lessens the potential damage to the bottom bar 106, the panel 104, and door lintel (labeled Wall" in FIGS. 11 and 12) because the bottom bar 106 has more clearance than in prior art configurations when being realigned for reinsertion of the panel 104 into the guides (not shown).

FIGS. 13 and 14 disclose that the invention is also advantageous for use in any roll door configuration because as the door closes (unwinding the panel 104) the panel 104 moves toward seals 108 which provides a better full seal as compared with the prior art disclosed in FIG. 13. As disclosed in FIG. 13, in prior art configurations the seals 108 for the door panel 104 (at a distance d1, FIG. 11) must suffer the friction of the moving panel during a majority of its opening and closing. The invention provides advantageous sealing contact for any seals around the entire perimeter of the door (at a distance d2 FIG. 12). When the door panel 104 opens, the panel 104 moves away from the seals 108 which minimizes wear and tear on the seals 108 and is also quieter because there is no rubbing between the panel 104 and seals 108 (and wind-ribs (not shown) when applicable).

FIG. 15 discloses another aspect of the invention wherein a portion of the flexible panel 110 (W1) is cut to the door opening width minus 1 inch on an assembly where the guides (not shown) extend into the opening 3 inches. The top of the panel 110 is door width plus 2 inches (W2). This provides support at the top of the panel 110 but also allows the bottom half of the panel 110 to break freely through the door opening. This according to this aspect of the invention, it is believed to provide an advantage whenever a door panel has at least a lower portion of which is substantially equal to, or less than, the width of the opening while an upper portion provides sufficient width over a significant length to guide the door and reasonably hold a wind load. The high-speed door assembly of Claims 1-6 further comprising a sensor coupled to the controller, the sensor being capable of detecting displacement of the door panel from its normal operative path of travel, wherein the controller being responsive to the sensor such that detection of the displaced door panel results in the controller changing its operating mode.

FIG. 16 discloses a guide 120 for a high-speed roll door assembly as disclosed hereinabove comprising a flexible door panel (not shown). The guides 120 each having an outer surface 122 directly exposed to vehicle traffic in a first direction through the opening and in an opposite direction through the opening, said outer surfaces being disposed at an angle to the plane of the door panel (identified as "P"). The angle of the vertical outer surfaces 122 dissect (see arrows in FIG. 16) the plane P of the door panel and each other. Also, guide 120 has a funnel shape formed at upper ends thereof sized and shaped so as to permit the door panel to reenter the guide 120 after being dislodged there from. Also, preferably, guide 120 has a pair of compound angles (disclosed by the letters alpha and beta in FIG. 16) formed at the upper ends thereof where one set of angles forms a funnel shape between them with respect to a thickness of the door and wherein the other set of angles form a funnel relative to a width of the door panel. These angles assist in reinsertion of a door panel when it becomes dislodged by an atypical force.

It is to be understood that additional embodiments of the high-speed door assembly described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A high-speed door assembly for selectively permitting and prohibiting access through an opening in a wall, or other blocking structure, the opening having a width, the high-speed door assembly comprising:

a shaft or drum located proximate the wall or other blocking structure and being outside of the opening, and the shaft or drum having a longitudinal axis which is configured so that the longitudinal axis is parallel with the wall or other blocking structure in which the opening is formed;

a seal located proximate the shaft or drum, the seal extending outwards from the wall substantially parallel to the shaft or drum; and, a flexible door panel attached to the shaft or drum so as to be capable of being wound and unwound about the shaft or drum for selectively permitting and prohibiting access through the opening, the door panel being wound on the shaft or drum in an orientation such that the door panel defines at least one vertical plane when unwound from the shaft or drum, the vertical plane being spaced farther from the wall or other blocking structure than the longitudinal axis of the shaft or drum is spaced from the wall or other blocking structure, the door panel and the seal being positioned relative to each other so that the seal and the door panel do not contact each other as the door panel is wound and unwound until the door panel is substantially unwound and positioned to prohibit access through the opening.

2. The high-speed door assembly of claim 1 further comprising:

the door panel having at least a lower portion of which is substantially equal to, or less than, the width of the opening.

3. The high-speed door assembly of claim 1 further comprising:

first and second guides operatively mounted proximate the opening and having a portion thereof with opposed guide surfaces extending into a width of the opening, at least a portion thereof being adapted to move in a direction to reduce their extension into the width of the opening upon impact of the flexible door panel by an atypical force.

4. The high-speed door assembly of claim 3 wherein the movable first and second guides are respectively mounted to the opposed sides within the opening.

5. The high-speed door assembly of claim 1 further comprising a controller operatively connected to an electric motor having a plurality of operating modes, one of which is capable of moving the door panel at a rate of speed of at least 48 inches/second.

6. The high-speed door assembly of claim 5 wherein a normal operative mode is capable of moving the door panel at a rate of speed of at least 80 inches/second.

7. The high-speed door assembly of claim 5 further comprising a sensor coupled to the controller, the sensor being capable of detecting displacement of the door panel from its normal operative path of travel, wherein the controller being responsive to the sensor such that detection of the displaced door panel results in the controller changing its operating mode.

8. The high-speed door assembly of claim 1 further comprising:

a first guide operatively mounted proximate the opening and having opposed surfaces between which a portion of the door panel is guided during normal opening and closing and wherein at least a portion of the opposed surfaces extends into the opening; and, a second guide operatively mounted proximate the opening and having opposed surfaces between which a portion of the door panel is guided during opening and closing and wherein at least a portion of the opposed surfaces extends into the width of the opening; and, further wherein the second guide being spaced apart from and aligned with the first guide to define a path of travel for the door panel such that a portion of the door panel is guided within the first and second guides.

9. The high-speed door assembly of claim 8 further comprising:

a portion of either the first or second guide being flexible so as to retreat at least partially from protrusion into the opening width upon impact thereto and being capable of substantially returning to an operative configuration.

10. The high-speed door assembly of claim 9 further comprising:

each guide includes realignment surfaces angled to facilitate automated return of the flexible door panel into their respective guides when the impact dislodged the door panel into either the width of or away from the opening.

11. The high-speed door assembly of claim 10 wherein the realignment surfaces comprise a compound angle.

12. The high-speed door assembly of claim 8 wherein the guides are formed by two opposing vertical elements presenting at least one vertical surface which is disposed at an angle to the vertical plane of the door panel.

13. The high-speed door assembly of claim 7 further comprising:

the sensor being configured to detect displacement of the door panel from its typical operative path of travel and transmit a signal to the electric motor indicating displacement of the flexible door panel from its typical operative path of travel; and, the controller and motor are configured to reduce the speed of travel of the flexible door panel in response to the detection of the displacement of the flexible door panel from its typical operative path of travel.

14. The high-speed door assembly of claim 1 further comprising:

a first guide operatively mounted proximate the opening and having opposed surfaces between which a portion of the door panel is guided during opening and closing and wherein at least a portion of the opposed surfaces extends into the opening;

a second guide operatively mounted proximate the opening and having opposed surfaces between which a portion of the door panel is guided during opening and closing and wherein at least a portion of the opposed surfaces extends into the opening; and, a guide moving assembly being operatively connected to at least one of the first or second guides, where, in conjunction with opening and closing of the door panel, at least a portion of the at least first or second guides is movable between a first position and a second position.

15. The high-speed door assembly of claim 14 wherein the guide moving assembly includes an actuator.

16. The high-speed door assembly of claim 15 wherein the actuator is a motor and cooperating cam.

17. The high-speed door assembly of claim 15 wherein the actuator is an air cylinder.

18. The high-speed door assembly of claim 15 wherein the actuator is an electric solenoid.

19. The high-speed door assembly of claim 14 wherein the guide moving assembly includes a gravity-based bias mechanism.

20. The high-speed door assembly of claim 15 further comprising:

a track upon which the first guide is operatively connected, wherein the actuator in cooperation with the track is capable of moving the at least first or second guide between the first and second position.

21. The high-speed door assembly of claim 14 wherein the guide moving assembly further comprises:

a counter-weight operatively attached to the door panel;

a chute mounted proximate the opening and operatively attached to the first guide, the chute including a path to guide the counter-weight; and, a deflection member attached to the first guide and positioned within the path to guide the counter-weight, wherein upon initial contact of the counter-weight with the deflection member, the guide will move.

22. The high-speed door assembly of claim 21 wherein the first guide being pivotably mounted proximate the opening.

23. The high-speed door of claim 1 further comprising:

first and second guide bodies each having at least first, second and third sides which are elongated to extend vertically proximate the opening through which commercial traffic such as persons, pallet mules, and forklifts traverse;

the first side of each guide body being either attached to or being formed as a part of a vertical side column which includes at least an attachment surface adapted to stabilize the position of the guide bodies relative to the wall or other blocking structure which maintains their vertical alignment for guiding the flexible door panel;

the second side of each guide body being attached to or being formed as part of either the vertical side column or their respective guide bodies or both, and being arranged to be spaced from and opposed to each other in such a manner as to provide a vertical channel or path for at least a vertical marginal edge of the flexible door panel to travel in during opening and closing to prevent or permit egress through the opening;

at least the third side of the first guide body being oriented at an angle with respect to a vertical plane generally defined by the door panel when it is in a closed position.

24. The high speed door assembly of claim 23 wherein the third side of the first guide body being located and oriented at a sufficient angle, and presenting a sufficiently large surface, that it assists in guiding alignment of the door panel for ultimate reinsertion between the first and second guide bodies, when it is in at least a partially closed position, and is being moved upwardly toward a fully open or to a reset position, after being dislodged in a first direction from between the second sides of the first and second guide bodies.

25. The high speed door assembly of claim 24 wherein the third side of the second guide body also being located, oriented at a sufficient angle, and presenting a sufficiently large surface, that it assists in guiding alignment of the door panel for ultimate reinsertion between the first and second guide bodies, when it is in at least a partially closed position, and is being moved upwardly toward a fully open or to a reset position, after being dislodged in a second direction from between the second sides of the first and second guide bodies.

26. The high speed door assembly of claim 23 wherein the first guide body is an elongate member having a cross sectional end surface at its uppermost end forming a surface which is at an angle to at least partially assist the door panel while lowering after a dislodgement in a first direction into a space between the second sides of the first and second guide bodies for normal operational guidance.

27. The high speed door assembly of claim 26 wherein the second guide body is an elongate member having a cross sectional end surface at its uppermost end forming a surface which is at an angle to at least partially assist the door panel while lowering after a dislodgement in a second direction, into a space between the second sides of the first and second guide bodies for normal operational guidance.

28. The high speed door assembly of claim 23 further comprising:

a first resilient seal attached to the second side of the first guide body and a second resilient seal attached to the second side of the second guide body, each seal having elongate vertical side surfaces and a free edge surface away from their respective second guide walls;

the first and second seals having cooperative angles and widths such that an edge of one contacts the side surface of the other when the door panel is not within the space between the second sides.

29. The high speed door assembly of claim 28 further comprising:

a second pair of first and second resilient seals attached to their respective second sides of the first and second guide bodies, each seal of the pair having elongate vertical side surfaces and a free edge surface away from their respective second guide walls and having cooperative angles and widths such that an edge of one contacts a side surface of the other when the door panel is not within the space between the second sides.

30. The high speed door assembly of claim 23 further including:

that the first and second guide bodies are exposed to commercial traffic traversing the opening but are each attached to a base which assists their stability in attachment proximate the opening, and in particular can be used to attach the guides to a vertical side column for the same purpose.

31. The high speed door assembly of claim 23 including:

that the guide bodies are comprised of a non-thermal conductor material comprising one or more of the following: a polymeric resin, or a filled polymeric resin, or other material with low thermal conductivity.

32. The high speed door assembly of claim 23 including:

that the guide bodies are comprised of a resilient material comprising one or more of the following: a natural or synthetic polymer such as, Buna-n, or Buna-S, such that the guide bodies will resiliently return substantially to their former shape after at least one impact by a motorized vehicle.

33. The high speed door assembly of claim 23 including:

that the guide bodies are extrusions forming an elongated space within the confines of at least the first, second, and third sides of the guide body.

34. The high speed door assembly of claim 33 including:

that a base of each of the guide bodies are extrusions forming an elongated space within its outer confines.

35. The high speed door assembly of claim 33 wherein the extrusions are hollow and are filled with a thermally insulating material such as a polymeric open or closed cell foam.

36. The high speed door assembly of claim 8 wherein a first portion of the door panel having a first portion where the width extends into the guides a first distance and a second portion where the width extends into the guides a second distance.

37. A high-speed door assembly for selectively permitting and prohibiting access through an opening in a wall or other blocking structure, the high-speed door assembly comprising:

a shaft or drum located proximate the wall or blocking structure and being outside of the opening;

at least one horizontally oriented seal located proximate an upper portion of the opening; and, a flexible door panel attached to the shaft or drum so as to be capable of being wound and unwound about the shaft or drum for selectively permitting and prohibiting access through the opening, the door panel being wound on the shaft or drum in an orientation such that the door panel defines at least one vertical plane when unwound from the shaft or drum, the at least one vertical plane moving horizontally farther away from the wall or other blocking structure in a horizontal direction as the door panel is wound up wherein the at least one vertical plane formed by the door panel contacts the at least one horizontally oriented seal when the door panel is in the fully unwound position, and moves away from the seal in a horizontal direction when the door panel is wound up.

* * * * *